United States Patent [19]

Yanagimoto et al.

[11] Patent Number: 4,664,175

[45] Date of Patent: May 12, 1987

[54] METHOD FOR CONTINUOUS CASTING OF METAL USING LIGHT AND LIGHT SENSOR TO MEASURE MOLD MELT INTERFACE

[75] Inventors: Shigeru Yanagimoto; Ryota Mitamura, both of Yokohama, Japan

[73] Assignee: Showa Aluminum Industries K. K., Tokyo, Japan

[21] Appl. No.: 855,308

[22] PCT Filed: Jul. 31, 1985

[86] PCT No.: PCT/JP85/00431

§ 371 Date: Mar. 24, 1986

§ 102(e) Date: Mar. 24, 1986

[87] PCT Pub. No.: WO86/00839

PCT Pub. Date: Feb. 13, 1986

[30] Foreign Application Priority Data

Jul. 31, 1984 [JP] Japan ..... 59/158735

[51] Int. Cl.[4] ..... B22D 11/22

[52] U.S. Cl. ..... 164/455; 164/452

[58] Field of Search ..... 164/475, 459, 473, 455, 164/449, 452, 150, 155, 415

[56] References Cited

U.S. PATENT DOCUMENTS 4,157,728 6/1979 Mitamura et al. .
4,355,679 10/1982 Wilkins ..... 164/475
4,420,250 12/1983 Kompa ..... 164/449

FOREIGN PATENT DOCUMENTS 54-42847 12/1979 Japan .
55-18585 5/1980 Japan .
55-18586 5/1980 Japan .

*Primary Examiner*—Kuang Y. Lin
*Attorney, Agent, or Firm*—Armstrong, Nikaido Marmelstein & Kubovcik

[57] ABSTRACT

In continuous casting of a non-ferrous metal melt by a gas-pressure impartation method, the cast skin of a large size ingot is usually impaired by the chilling effect of a mold, and it is difficult to stably produce a large size ingot. This difficulty is overcome by controlling the quantity of gas inflow in accordance with the quantity of the light emitted from a light source provided below a mold and laterally to an ingot, which light reaches a separate chamber for gas-pressure impartation.

8 Claims, 10 Drawing Figures

METHOD FOR CONTINUOUS CASTING OF METAL USING LIGHT AND LIGHT SENSOR TO MEASURE MOLD MELT INTERFACE

DESCRIPTION

1. Technical Field

The present invention relates to a method for continuous casting of metal, particularly to a method for the gas-pressure impartation type continuous casting of non-ferrous metal.

2. Background Art

The cast lump (hereinafter referred to as ingot) which is a starting material to be used in rolling, extrusion, or other plastic workings, of metal (including alloy) is produced mainly by continuous casting. Particularly for non-ferrous metals, a continuous casting using a perpendicular, fixed mold is generally adopted. This procedure includes the float method, hot-top method, spout method, and other methods with variations in the means for feeding the molten metal. In the float method, a floating distributor is floated on the surface of a melt, to keep the level of the molten metal constant, to uniformly distribute the stream of the melt, etc., and molten metal is fed via the floating distributor from a spout to a perpendicular, fixed mold. In the hot-top method, a melt-receiving reservoir made of heat-insulating refractories is provided on the upper portion of a perpendicular, fixed type open mold, so that the high hydrostatic pressure of the molten metal is maintained at the solidified layer in a metal ingot. In the spout method, the individual floating distributors and spouts are not paired, but, instead, one spout is provided for several floating distributors and the inflow of molten metal therefrom into the perpendicular, fixed type open mold is arrested and released by means of a stopper, so that a desired inflow amount of molten metal is obtained.

For the above-mentioned methods for continuous casting, a recent principal improvement is a gas-pressure impartation method. This is mainly intended to improve the cast skin and the surface layer structure of the ingot. This method uses the gas-pressure impartation in the hot-top continuous casting. For example, according to the inventions disclosed in Japanese Examined Patent Publication Nos. 54-42847, 55-18585, and 55-18586, in the so-called hot-top method wherein a melt-receiving reservoir made of refractory is provided at an upper portion of a cylindrical mold, a method has been proposed wherein the inner lower-end surface of the melt-receiving reservoir projects inside the inner-wall of the mold so that an overhanging portion is formed, molten metal is poured into the mold and the melt-receiving reservoir, and gas is introduced just below the overhanging portion so that a gas pressure is applied to the outer circumferential surface of the molten metal.

In this method, the application of the gas pressure pushes downward the portion at which the circumferential surface of molten metal is in contact with the mold below the compulsorily cooled mold, which shortens the axial contact length between the melt and the mold and thereby, particularly, a cast surface having an excellent smoothness and a thin layer of inverse segregation is considered to be advantageously obtained. In the above-mentioned inventions, the operation conditions to achieve an expected effect are disclosed in terms of the interrelationship among and the ranges of three factors, i.e., the gas flow rate, the lubricant oil flow rate, and the level of the melt in the melt-receiving reservoir. According to the study carried out by the present inventors, it has been observed that the above inventions are most suitable for the continuous casting of medium and small size billets and able to stably produce excellent billets, but it is difficult to obtain an expected effect for the continuous casting of large size billets with a large section, and sheet slabs for rolling use.

The second method is the gas-pressure impartation in a separate chamber of a mold.

That is, as disclosed in U.S. Pat. No. 3,533,462 and Japanese Unexamined Patent Pub. No. 54-132430, a gas-pressure impartation type continuous casting is described, wherein a sleeve is concentrically provided at the upper portion of the inner circumferential surface of a compulsorily cooled mold, a gas pressure is applied to the meniscus surface of molten metal entering a separate chamber defined by the inner circumferential surface of the mold and the outer circumferential surface of the sleeve, and thereby the axial contact length of the melt with the mold is adjusted independently of the varying amount of molten metal within the mold. In the method of this invention, the decrease of the above-mentioned contact length due to the application of a gas pressure is expected such that, even for large size billets, e.g., of a diameter of 14 inches or more and slabs, e.g., of a section of about 200 $cm^2$ or more, an improvement in the cast skin is attained. Additionally, the above-mentioned inventions pointed out, as adjustable factors in the continuous casting of non-ferrous metal using perpendicular mold, the temperature of molten metal, the speed of molten metal flow, the cooling water flow rate, the casting rate, the molten metal level in the mold, and the above mentioned contact length, and regarded it as a particular advantage from the viewpoint of improvement of the cast skin of ingot, etc., that the contact length can be extensively adjusted independently of other adjustable factors. In this invention, as a method for optimizing the application condition of gas pressure, a so-called feed-back method is shown, wherein the optimum condition of gas pressure is found according to the quality of ingots formed through casting. However, in accordance with the test by the present inventors and others, it was observed to be difficult for an expected effect to stably appear even by the combination of the above-mentioned adjustable factors. Consequently, it was found that the hydrostatic pressure, etc. of the melt applied by a gas pressure to the portion of the melt in contact with the compulsorily cooled mold is also strongly effective, as well as the contact length between a compulsorily cooled mold and a melt. Problems are involved, that is, manual assistance for control is necessary for realizing the momentarily optimized control upon the fluctuation of the casting condition and upon the casting start or completion, automatization is difficult, and ingots with a good cast skin are not stably obtained.

DISCLOSURE OF THE INVENTION

An object of the present invention is to provide a method for a gas-pressure impartation type continuous casting of non-ferrous metal as mentioned above, wherein an effect of decrease in the axial contact length of the molten metal with a compulsorily cooled mold can be directly observed. Particularly, it is an object of the present invention to provide a method, wherein the ingots having a smooth cast skin and excellent surface layer structure in the continuous casting of the large size billets and slabs for rolling use can be stably produced.

In various experiments of the gas-pressure impartation type continuous casting, the present inventors found that, when light is directed to the outer circumferential surface of an ingot drawn out downward from an open mold, a leakage of light from the inner surface of the mold just above the thus light-directed outer surface of the ingot is observed above the mold, and the intensity of the thus leaked light is a barometer indicating the degree of contact (contact length, contact pressure, etc.)of molten metal with the inner surface of the mold. Then, in order to further confirm this phenomenon, a light source with a certain intensity was provided below the open mold and laterally to the ingot, light from the light source was directed to the outer circumferential surface of the ingot, a light sensor was oriented from above to an inner surface of mold, the inner surface being just above the thus light-directed outer surface. Thus, the inventors observed the relationship among the reached quantity of light leaking from below, the degree of gas-pressure application, and the quality (cast skin, surface layer structure) of the ingot thus obtained. As a result it was found that the gas-pressure impartation has a sufficient effect and the molten metal virtually does not come into contact with the inner surface of a mold when an excellent quality ingot was obtained. Namely, when the effect of gas-pressure impartation was insufficient, the light from the light source was feeble or not observed at all.

The present invention is based upon the above-mentioned finding.

In a method for the continuous casting of a non-ferrous metal, wherein a pressure of gas is imparted to a peripheral portion of the molten metal in contact with a lateral inner wall of an open mold and is thereby compulsorily cooled, the constitution of the present invention is characterized in that a light source is located below the open mold and laterally to an ingot, the impartation of gas pressure is performed at a degree such that light from the light source reaches a separate chamber above the peripheral portion, into which chamber the gas flows, and the quantity of the gas inflow is adjusted according to the quantity of the thus reaching light.

The constitution of the present invention will be described below.

In a continuous casting, wherein gas pressure is imparted to a peripheral portion of the molten metal within a compulsorily cooled open mold, the space formed by the gas impartation is not gastight. According to the aforementioned Japanese Examined Patent Publication No. 54-42847, it is known that the continuous introduction of a gas at a certain flow rate into the above space is necessary in order to maintain a constant gas pressure in the above space. This phenomenon was explained such that the melt is fast-cooled by contact with the inner surface of a compulsorily cooled mold, a thin solidified shell is formed at the outer surface of the melt with a simultaneous generation of a solidification constriction which causes the solidified shell to separate from the inner surface of the mold, and gas flows out downward through the thus formed minute gap(s) at the contacting interface between the inner surface of the mold and the solidified shell.

The present inventors observed that, under a casting condition bringing preferable results, the melt is close to the inner surface of the mold but seems, from optical observation, not to be in contact therewith. Further, after a necessary pressure is added to a gas-pressure imparting space, excess gas discharges downward through the minute gap between the inner wall of mold and the solidified shell (in the form of a film) at the outer surface of the melt. In this case, it was also observed that the gap is formed considerably uniformly along the circumferential direction of the mold.

In the present invention, the number of photometers provided to measure the light quantity reaching the separate chamber for gas inflow is one or plural at arbitrary position(s) in the circumferential direction of the mold for both a cylindrical billet and a prismatic slab. For slabs, it is preferable to provide one photometer at the wide side, and more preferable to provide one photometer at each of the wide and narrow sides. The size of the window for the photometer is not particularly limited, if it is sufficient to enable the light from the light source to be detected and the luminous intensity measured. When one light source is provided, since the light from the light source is detected in an image box as a dark/bright contrast in an arc or line form, the size of the window is determined so that the arc- or line-formed light beam runs across the visual field of the window, etc.

The light source of the present invention is located below the lower end of an open mold and adjacent to the ingot. The distances from the open mold and the ingot to the light source may not be strictly selected, because scattering probably leads the light to the sealed window. Additionally, as the kind of the light source of the present invention, known light-emitting means which emit a visible ray, an ultra-violet ray, etc. may be used.

As the method for controlling the gas-pressure impartation effect of the present invention, a method wherein the casting factors are controlled to maintain the luminous intensity within a certain range is generally carried out. The upper limit of the luminous intensity is determined so that the molten metal is maintained in a predetermined shape by the solidified shell, that is, there is little danger of a break out occurring.

Further, as the controlling method of the present invention, various kinds of methods generally known in control technology may be applied. For example, the control may be performed so that the integral of the luminous intensity with time is in the range from the upper to the lower limits.

Further, the light intensities of the light source are set at several levels, and various levels are suitably selected according to the timing of the casting sequence, etc., so that the condition of the interface between the mold and molten metal can be directly detected.

When the kind of metal and the size of an ingot are given, the usual casting factors, i.e., the gas flow rate, the viscosity and amount of lubricant oil supplied, the falling speed of the ingot (the casting rate), and the amounts of the primary (in the compulsorily cooled mold) and secondary (the direct water injection outside and below the mold) cooling water are subjected to control as the operation factors for controlling the above luminous intensity to be within the predetermined range. Additionally, in the steady-state operation of the gas-pressure impartation type continuous casting, it is most proper to take only the amount of gas flow as the variable operation factor and preset the optimum values of other factors. In this case, since the controllability of casting is excellent, when, for instance, the light quantity (the luminous intensity) becomes close to or exceeds the lower limit, the gas flow rate is caused to increase and thereby again separate the molten metal sufficiently from the inner-wall surface of the mold, and hence, the optimum gas impartation effect is obtained.

According to the above-mentioned method of the present invention, the interfacial condition between the mold and molten metal can be virtually directly detected, which leads to the production of ingots with a good cast skin at a higher stability and reproduceability in comparison with the conventional methods for the gas-pressure impartation type continuous casting. It has heretofore been recognized that a mitigation of the chilling effect of the mold is preferable for obtaining an ingot with a good cast skin. However, there has been no suitable means for control, and a remarkable mitigation of the chilling effect contained a danger such that the casting itself will become nonperformable.

The present invention obviates the restriction at this point completely, and enables a control of continuous casting wherein the chilling effect of a mold is extremely suppressed even, for a process such that the casting conditions momentarily vary.

BEST MODE FOR CARRYING OUT THE INVENTION

Below, an embodiment of the present invention will be described in detail with reference to the figure showing a casting method using a continuous casting apparatus of the aforementioned second type with a separate chamber formed by sleeve.

Figure 1:
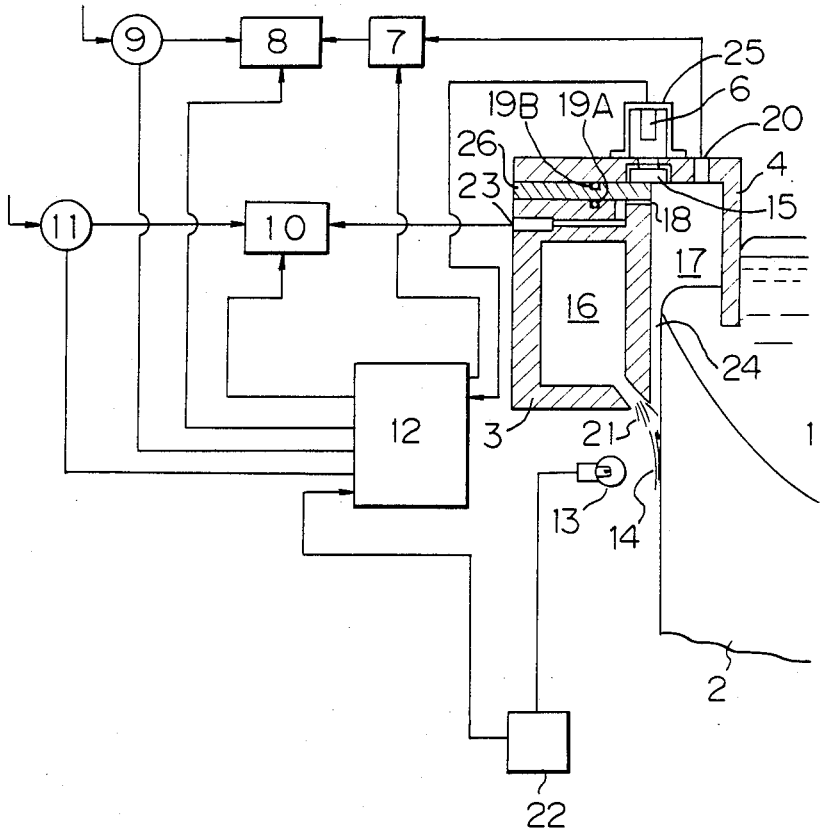
FIG. 1 is a perpendicular sectional view of the main portion of one type of apparatus for continuous casting, which can be utilized for carrying out the method according to the present invention, with a block diagram of the control apparatus thereof.

In FIG. 1, 1 is the molten metal, which is compulsorily (primarily) cooled by cooling water 16 in an open mold 3, and is then cooled by a direct water injection (secondary cooling) 26 outside and below the mold and is made into ingot 2, which then falls from the open mold 3 at an optimum casting rate predetermined by efficiency and product quality. In order to form a separate chamber 17 for performing the gas-pressure impartation type continuous casting, a sleeve 4 is fixed to the open mold 3 so that the separate chamber is concentrically formed for billet casting or with a square profile for slab casting.

Lubricant oil inlets 23, via which lubricant oil is introduced, are provided by boring the open mold 3. A number of slits 18 allowing the lubricant oil to flow into the separate chamber 17 are radially formed at the upper portion of the open mold 3 (FIG. 1 shows only one slit 18). Reference 19A is a seal-ring which maintains the slit 18 in a liquid-tight condition. In order to introduce gas into the above separate chamber 17, a gas inlet 20 is provided by boring at a portion of the sleeve 4. In order to homogenize the lubricant oil outflow from the slit 18 and to prevent an observation hole 15 from being immersed in the lubricant oil, a spacer 26 is provided between the sleeve 4 and the upper surface of the mold 3. 19B is a seal-ring which maintains the separate chamber 17 in an gastight condition. On the other hand, a light source for performing the control method of the present invention is located at the secondarily-cooled region, which is cooled by cooling-water injection 21, and is connected to a power source 22 with a constant or variable-set voltage. Light in the form of a slit or strip from the light source 13, which passes through a mold-/melt interface 24 and reaches the separate chamber 17, is detected by a photometer 6 having functions for receiving light and measuring the luminous intensity thereof. An observation hole 15 is formed at a portion of the sleeve 4. Just above the hole 15, a cover 25 for maintaining the separate chamber 17 in a gastight condition is fixed on the sleeve 4. In order to protect the photometer 6 from direct exposure to radiant heat from the surface of a melt in the separate chamber 17, a heat-resisting glass may be provided between the separate chamber 17 and the photometer 6.

A control method according to the present invention may be easily carried out by combining the above-mentioned members of the apparatus for continuous casting with suitable control means, e.g., a device for measuring the instantaneous and integral values of luminous intensity, a timer for setting time, a device for setting the standard or upper/lower values of the luminous intensity in terms of casting factors, a device for comparing measured values with preset values, an operation-control device for changing casting factors (the quantity of gas inflow, the quantity of melt poured, etc.) when a comparison value reaches a certain value, an evaluation circuit for memorizing the number and kind of operations, a circuit for previewing or detecting the start and completion times of casting and changing preset values, and other means, circuits, devices, etc., which are known in general or in the control of a continuous casting.

In the embodiment shown in FIG. 1, 7 is a gas-flow rate and pressure detecting device, 8 is a gas-flow rate adjusting valve, 9 is a gas-flow cutting-off electromagnetic valve which communicates with a not-shown gas supply source and cuts-off the gas flow upon a casting start, stop, or emergency, 10 is a lubricant-flow rate adjusting device, 11 is a lubricant-flow cutting-off electromagnetic valve which communicates with a not shown lubricant supply source and cuts-off the lubricant flow upon a casting start, stop, or emergency, and 12 is a light-quantity adjusting device. The method according to the present invention is carried out in general, particularly in the steady-state casting, by taking the luminous intensity as a controlling factor and the gas flow rate as an operation factor, and the gas flow-rate adjusting valve 8 is opened and closed for adjustment by the light quantity adjusting device 12. Further, the monitoring of gas pressure carried out simultaneously with the above adjustment enables the luminous-intensity control, consequently, the casting itself to be stopped immediately, by previewing or detecting an unusual casting condition of complete dissipation of the gas-pressure application effect.

The present invention also exhibits an excellent effect in the aforementioned first type, i.e., a hot-top continuous casting using the gas-pressure impartation. Below, an embodiment shown in FIG. 2 will be described.

Figure 2:
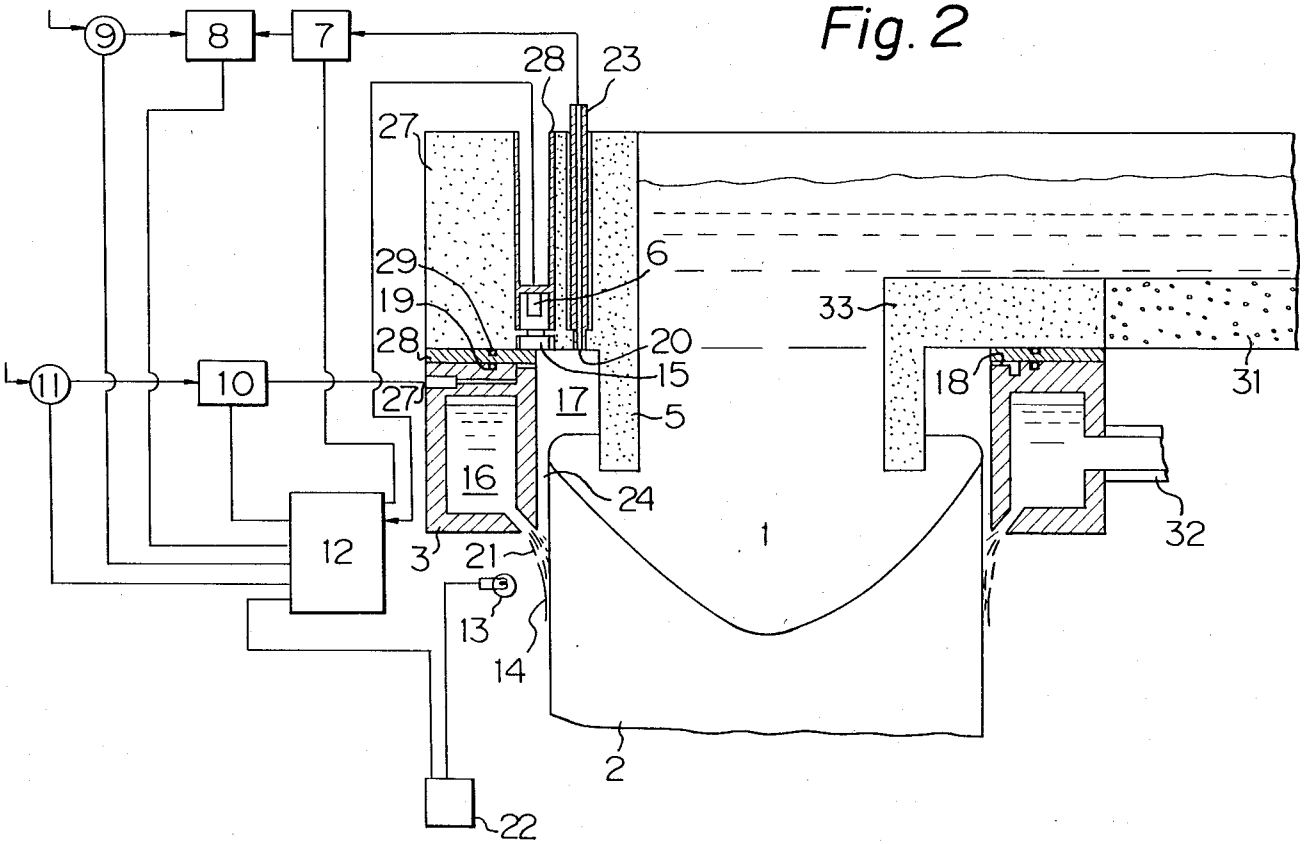
FIG. 2 is a perpendicular sectional view of the main portion of another type of apparatus for continuous casting, which can be utilized for carrying out the method according to the present invention, with a block diagram of the control apparatus thereof.

In FIG. 2, 27 is a melt-receiving reservoir (hot-top) made of heat-insulating material, which is fixed to an upper portion of a mold 3 cooled by cooling water 16. Inside and below the melt-receiving reservoir, a sleeve 5 trailing downward and inside the mold is formed in one body, with a gap at the inner surface of the mold 3, to form a separate chamber 17. Two holes are provided, perpendicularly and downwardly piercing the melt-receiving reservoir and communicating with the separate chamber 17; one hole is a cylindrical body 28 enclosing a photometer at the bottom thereof; and the other is an introduction pipe 23 for introducing gas into the separate chamber 17. The photometer 6 is provided so that it is directed to a portion just above the inner surface of the mold within the separate chamber 17, as shown in the figure. The cylindrical body 28 and the introduction pipe 23 are made of metal or ceramics.

The right half of FIG. 2 shows a perpendicular section of a melt-introduction portion of a hot-top. Melt introduced via a melt-pouring conduit 31 flows via a melt-introduction portion 33 of a melt-receiving reservoir, through the inside of a sleeve 5, into the mold 3 and fills the inside of the mold. The height of the melt surface in the separate chamber 17 is suppressed by the introduced-gas pressure. The introduced gas adjusts the height of the melt surface in the separate chamber 17, where the excess of the gas flows out downward from a minute gap between the inner-wall of the mold and the solidified shell of the melt.

Cooling water for the mold flows in via 32, cools the mold, and then becomes the secondary cooling water which gushes out of a slit at the lower portion of the mold directly onto the outer surface of the solidified metal, thereby cooling it.

The constructions and functions other than those mentioned above are the same as in the case of the aforementioned FIG. 1.

Below, examples according to the present invention will be described on the basis of the above first and second types.

[EXAMPLE 1]

In the casting apparatus shown in FIG. 1, a reflector type projection lamp with a luminous intensity of 6000 cd (candela) was used as a light source 13 which irradiates the surface of a cast lump during casting. A photodiode, (Ando Electric Co. Type AQ-1976) was used as a photometer 6 which receives the light passing through the separate chamber. This photodiode is characterized by an effective light-receiving area of about 18 mm in dia., a sensitive wave-length range of from 450 to 1100 nm, a standard wave-length of 633 nm, and a light-receiving power range of from 10 nW to 10 mW (for standard wave-length), etc.

A light-power meter from the same manufacturer (Type AQ-1135) was used as a measuring instrument for light-power, by which the absolute power of light was measured. Further, the output from the photodiode was communicated with the control system for the gas flow rate and the lubricant flow rate.

By using these apparatuses, Al alloy 2017 (AA standard) was cast under the following casting conditions:

billet size: 14 inches in diameter,
gap between open mold 3 and sleeve 4: 40 mm,
casting rate: 50 mm/min,
gas flow rate: 2.5 l/min (reference value),
gas pressure: about 500 Pa (reference value), and
lubricant oil flow rate: 10 $cm^3$/min (constant).

In the above steady-state casting where the gas flows stably at the reference values, light from the light source was nearly always detected, where the average incident light-quantity into the photometer was 6 μWatt.

Figure 3:
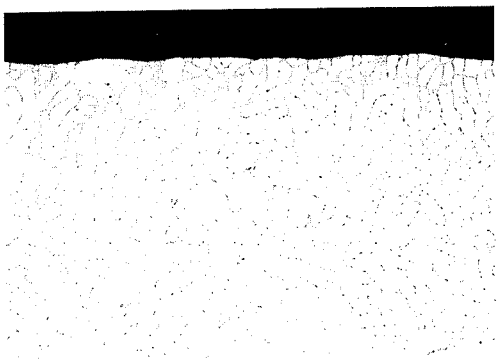
FIGS. 3 and 4 are microphotographs of the structures just below the surfaces for ingots of Alloy 2217 (AA standard) of Example 1 and Comparative Example 1, respectively.
Figure 7:
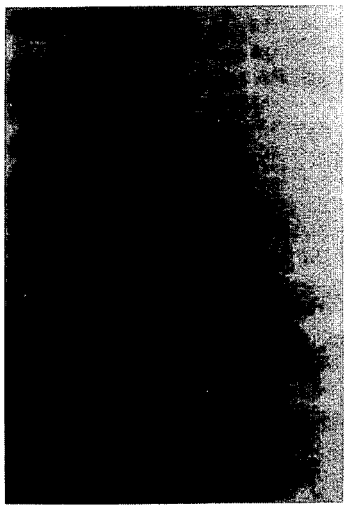
FIGS. 7, 8, 9, and 10 are the photographs showing the cast skins for ingots of Example 1, Comparative Example 1, Example 3, and Comparative Example 3, respectively.

Then the gas flow rate was changed so that the integral value of the light quantity for 10 sec was maintained at a reference value of 60 μWatt.sec. After this, casting continued stably regardless of the varying casting conditions, such as fluctuation of the melt surface, the temperature of the poured melt, etc. The ingot obtained by this control method was so excellent along the total length of 6 m that the cast skin was smooth and contained no defects. This is shown in FIG. 7. Additionally, regarding the microstructure just under the cast skin, a microphotograph at a magnification of 130 is shown in FIG. 3. The average thickness of a segregation layer just under the cast skin is shown in Table 1. The thickness of the segregation layer was as thin as 90 μm.

However, when the reference value of the incident-light quantity was set at 45 μWatt.sec, the average gas flow rate became 1.5 l/min and the gas pressure became 300 Pa. This resulted in a cast skin with fusioned penetration having convexes in the form of a string. On the other hand, when the reference value of the incident-light quantity was set at 75 μWatt.sec, the gas accumulated in the separate chamber blew out continuously, around the lower end of sleeve, into the melt in the mold. This caused violent fluctuations in the gas flow rate around 3.5 l/min and the gas pressure around 700 Pa. Finally, the solidified shell broke out with the result that it became hard to continue the casting.

[COMPARATIVE EXAMPLE 1]

The same apparatus as in Example 1 was used, except that the light source 13 and the photometer 6 were not operated. The same alloy 2017 (AA standard) as in Example 1 was cast according to the operation means disclosed in the aforementioned Japanese Unexamined Patent Publication No. 54-132430 and under the following casting conditions:

billet size: 14 inches in diameter,
gap between open mold 3 and sleeve 4: 50 mm,
casting rate: 50 mm/min,
gas flow rate: 3.0 l/min (reference value), and
lubricant oil flow rate: 20 $cm^3$/min.

When the above gas flow rate was decreased, the melt which entered the sleeve solidified, with the result that the casting had to stop. When the gas flow rate was increased over the above value, the gas passed around the lower end of the sleeve and violently blew into the melt in the mold and, further, the melt splashed out of the mold. Simultaneously, melt solidified in the separate chamber between the slit and the mold, with the result that it became impossible to continue the casting.

Figure 4:
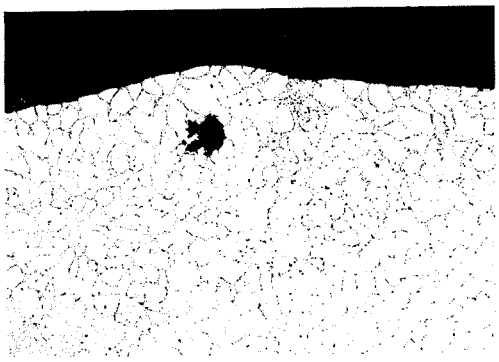
Figure 8:
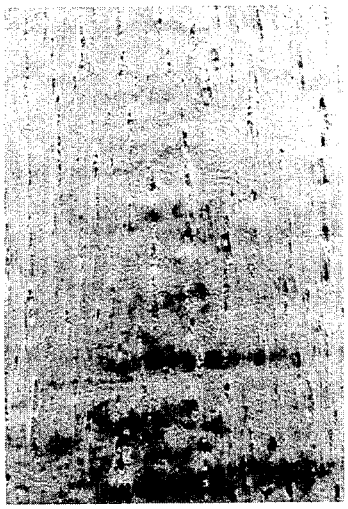

Regarding the thus obtained ingot, the cast skin had an inferior smoothness as shown in FIG. 8, the surface layer structure was as shown in FIG. 4, the segregation layer was thick as shown in Table 1, and thus the quality of the ingot was inferior to that in Example 1 of the present invention.

[EXAMPLE 2]

The apparatus shown in FIG. 1 and the same light source 13 and photometer 6 as in Example 1 were used. Al alloy 7075 (AA standard) was cast under the following casting conditions:

billet size: 14 inches in diameter,
gap between open mold 3 and sleeve 4: 50 mm,
casting rate: 70 mm/min,
gas flow rate: 3.5 l/min (reference value),
gas pressure about 650 Pa (reference value), and
lubricant oil flow rate: 20 $cm^3$/min (constant).

In the above steady-state casting where the gas flows stably at the reference values, light from the light source was always detected, where the average incident light-quantity into the photometer was 6.5 μWatt.

Then the gas flow rate was changed so that the integral value of the light quantity for 10 sec was maintained at a reference value of 60 μWatt.sec. After this, casting continued stably regardless of the varying casting conditions, such as fluctuation of the melt surface, the temperature of the poured melt, etc. The ingot obtained by this control method was excellent and the cast skin was smooth and contained no defects. The average thickness of the segregation layer just under the cast skin was as small as 80 μm (Table 1).

However, when the reference value of the incident-light quantity was set at 45 μWatt.sec, the average gas flow rate became 1.6 l/m and the gas pressure became 300 Pa. This resulted in a cast skin with fusioned penetration having convexes in the form of a string. On the other hand, when the reference value of the incident-light quantity was set at 75 μWatt.sec, the gas accumulated in the separate chamber blew out continuously, around the lower end of the sleeve, into the melt in the mold. This caused violent fluctuations in the gas flow rate around 4.5 l/min and the gas pressure around 850 Pa. Finally, the solidified shell broke out with the result that it became hard to continue the casting.

[COMPARATIVE EXAMPLE 2]

7075 alloy (AA standard) was cast according to the same method as in Comparative Example 1. The casting conditions were also the same as in Comparative Example 1. The instability of operation condition during casting was similar to that in Comparative Example 1. The cast skin of the ingot obtained was unsatisfactory, since there were many concavities and convexities on the skin. The segregation layer was obviously inferior to that of Example 2 as shown in Table 1.

[EXAMPLE 3]

Al alloy 5056 (AA standard) was cast into a slab with a thickness of 350 mm and a width of 700 mm for rolling-use, by using the casting apparatus shown in FIG. 2. The light source 13 and the photometer 6 were the same as used in Examples 1 and 2. Two points were selected as the control points at the control portions of the wide and narrow sides, at which the light source 13 and the photometer 6 were set, respectively.

The casting conditions were as follows:

gap between open mold 3 and sleeve 5: 50 mm,
casting rate: 60 mm/min,
gas flow rate: 6 l/min (reference value),
gas pressure: 2.5 KPa (reference value), and
lubricant oil flow rate: 30 $cm^3$/min (constant).

Setting of photometers:

one at a central portion corresponding to the wide side,
one at a central portion corresponding to the narrow side, and
one at a portion corresponding to the corner.

Figure 5:
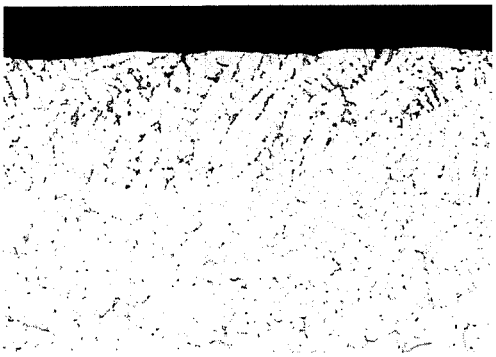
FIGS. 5 and 6 are microphotographs of the structures just below the surfaces for ingots of Alloy 5182 (AA standard) of Example 3 and Comparative Example 3, respectively.
Figure 9:
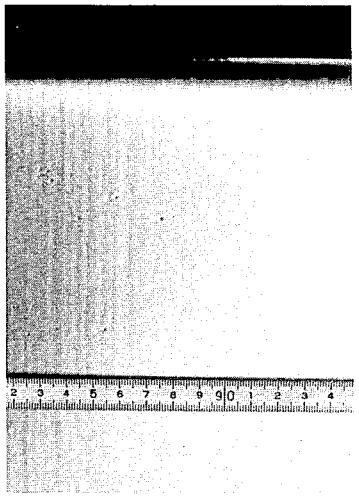

In the above steady-state casting where the gas flows stably at the reference values, light from the light source was nearly always detected, though it was not instantaneously detected. In this case, the incident-light quantities were 5.5 μWatt for the wide side and 6 μWatt for the narrow side. Then, control of the gas flow rate was changed so that the integral values of incident-light quantities for 10 sec were maintained at the reference values for the wide side of 55 μWatt.sec and for the narrow side of 60 μWatt.sec. As a result, the casting could be stably continued regardless of the varying casting conditions, such as fluctuation of the melt surface, the temperature of the poured melt, the varying casting rate with the varying casting length, etc. The ingot obtained by this control method was excellent along the total length of 4.5 m and the cast skin was smooth and contained no defects. The cast skin was also smooth at the corner portions. The cast skin including the corner portion is shown in FIG. 9. Additionally, regarding the microstructure just under the cast skin, a microphotograph at a magnification of 130 is shown in FIG. 5. The average thickness of the segregation layer just under the cast skin is shown in Table 1. The thickness of the segregation layer was as thin as 95 μm. A slab for rolling-use with an excellent quality was obtained.

However, when the reference values of the incident-light quantity were set at 40 and 45 μWatt.sec for the wide and narrow sides, respectively, the average gas flow rate became 3.5 l/min and the gas pressure became 1.5 KPa. This resulted in a cast skin having an exudation surface.

On the other hand, when the reference values of the incident light quantity were set at 70 and 75 μWatt for the wide and narrow sides, respectively, the gas accumulated in the separate chamber blew out continuously, around the lower end of sleeve, into the melt in the mold. This caused violent fluctuations in the gas flow rate around 8 l/min and the gas pressure around 3.3 KPa. Finally, the solidified shell at the corner portion broke out with the result that it became hard to continue the casting.

[COMPARATIVE EXAMPLE 3]

Alloy 5182 (AA standard) similar to that of the above-mentioned Example was cast into a slab for rolling use with the same size as the above, according to the gas-pressure impartation type hot-top casting method disclosed in the aforementioned Japanese Examined Patent Publication No. 54-42847.

Figure 6:
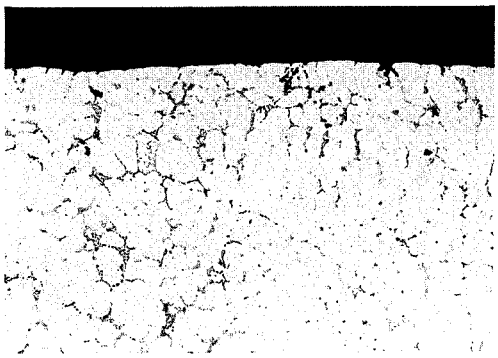
Figure 10:
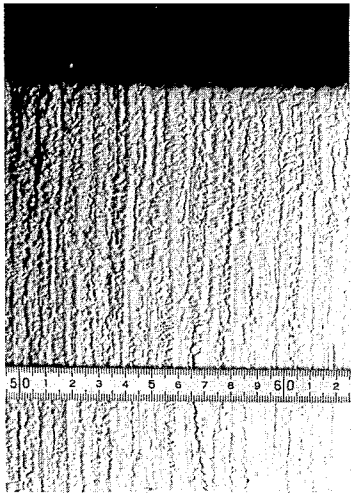

The casting conditions are as follows:

casting rate: 60 mm/min,
gas flow rate: 8 l/min, and
lubricant oil flow rate: 40 $cm^3$/min The ingot thus obtained showed a so-called exudation surface along the whole length. A representative sample of this cast skin is shown in FIG. 10, and the microstructure of surface layer is shown in FIG. 6. The ingot was unsatisfactory since the segregation layer is considerably thick in comparison with the above Example 3 as is shown in Table 3.

TABLE 1

| Alloy | Average Thickness of Segregation Layer at Surface Layer of Ingot | | |
|---|---|---|---|
| | AA2017 | AA7075 | AA5182 |
| Example | (1) 90 μm | (2) 80 μm | (3) 95 μm |
| Comparative Example | (1) 450 μm | (2) 400 μm | (3) 700 μm |

Notes
(1) Numerals in parentheses are the number of Examples and Comparative Examples.
(2) Thickness of segregation layer was measured on the surface along the casting direction, under a microscopic magnification of 60. The values in the table are the average values of the representative five points.

CAPABILITY OF EXPLOITATION IN INDUSTRY

It will be understood that, according to the present invention, a high quality, large size billet (more than 14 inches in dia) and a large section slab (more than about 200 $cm^2$) can be stably provided with a simultaneous remarkable mitigation of the chilling effect of the mold.

We claim:

1. In a method for continuous casting of non-ferrous metal wherein gas pressure is imparted to a peripheral portion of said molted metal which is in contact with an lateral inner wall of an open mold and is thereby cooled by said contact to form an ingot, the improvement wherein a light source is located below said open mold and laterally of said ingot, said impartation of gas pressure is performed at a degree such that light from said light source reaches a separate chamber above said peripheral portion, into which chamber the gas flows, and the quantity of the gas inflow is adjusted according to the quantity of the light reaching said separate chamber.

2. A method for continuous casting according to claim 1, wherein said separate chamber having one of the forms selected from the following: a form concentric to the inner surface of said open mold and a form of square profile is partially defined by said inner surface.

3. A method for continuous casting according to claim 2, wherein said separate chamber is provided by an interval between a sleeve and said inner surface of said open mold, said sleeve trailing downward below an overhanging portion formed by an inner lower end of a melt-receiving reservoir made of refractories provided at an upper portion of said open mold, and said inner lower end projecting inside the inner surface of said open mold.

4. A method for continuous casting according to claim 2, wherein said separate chamber is formed by a sleeve fixed to said open mold.

5. A method for continuous casting according to any one of claims 3 and 4, wherein a light-emitting means which emits a visible or an ultra-violet ray is used as a light source.

6. A method for continuous casting according to any one of claims 3 and 4, wherein the gas flow rate is decreased when the quantity of light reaching said chamber increases in comparison to a predetermined reference light quantity, and the gas flow rate is increased when the quantity of light reaching said chamber decreases in comparison to said predetermined reference light quantity.

7. A method for continuous casting according to claim 2, wherein said ingot is a billet with a diameter of at least 14 inches.

8. A method for continuous casting according to claim 2, wherein said ingot is a slab with a cross-sectional area of about at least 200 $cm^2$.

* * * * *

UNITED STATES PATENT AND TRADEMARK OFFICE

CERTIFICATE OF CORRECTION

PATENT NO. : 4,664,175

DATED : May 12, 1987

INVENTOR(S) : YANAGIMOTO et al

It is certified that error appears in the above-identified patent and that said Letters Patent is hereby corrected as shown below:

Claim 1, Column 11, line 29, "molted" should read --molten-- and "an" should read --a--.

Signed and Sealed this

Twenty-ninth Day of March, 1988

*Attest:*

DONALD J. QUIGG

*Attesting Officer*

*Commissioner of Patents and Trademarks*